United States Patent [19]

Stenlund

[11] Patent Number: 4,532,151

[45] Date of Patent: Jul. 30, 1985

[54] METHOD FOR COATING A SURFACE WITH A LAYER

[75] Inventor: Stig Stenlund, Saltsjöbaden, Sweden

[73] Assignee: HEP Products AB, Älvsjö, Sweden

[21] Appl. No.: 588,869

[22] PCT Filed: Jun. 17, 1983

[86] PCT No.: PCT/SE83/00250

§ 371 Date: Feb. 15, 1984

§ 102(e) Date: Feb. 15, 1984

[87] PCT Pub. No.: WO84/00016

PCT Pub. Date: Jan. 5, 1984

[30] Foreign Application Priority Data

Jun. 18, 1982 [SE] Sweden ..... 8203782

[51] Int. Cl.[3] ..... B05D 3/06; B05D 7/22; C23C 13/08; B05C 3/02

[52] U.S. Cl. ..... 427/54.1; 118/50.1; 118/408; 118/642; 427/238; 427/294; 427/295

[58] Field of Search ..... 118/50, 407, 408, 50.1, 118/642; 427/294, 295, 238, 54.1

[56] References Cited

U.S. PATENT DOCUMENTS

| | | | |
|---|---|---|---|
| 3,735,729 | 5/1973 | Bird | 118/407 X |
| 3,749,053 | 7/1973 | Timson | 118/412 X |
| 3,895,603 | 7/1975 | Barouh et al. | 118/223 X |
| 4,366,012 | 12/1982 | Wood | 427/238 X |
| 4,384,014 | 5/1983 | Young | 427/295 X |

*Primary Examiner*—Michael R. Lusignan

*Attorney, Agent, or Firm*—Pollock, Vande Sande and Priddy

[57] ABSTRACT

In a method for coating a surface with a layer the surface is first subjected to vacuum in a vacuum zone (V) sealed against the surface, whereupon liquid for forming the layer is supplied to the surface in a sealed pressure zone (P) following the vacuum zone. The supplied liquid is then spread out in a controlled manner, preferably by the sealing (13) terminating the pressure zone. FIG. 1.

12 Claims, 4 Drawing Figures

METHOD FOR COATING A SURFACE WITH A LAYER

The present invention relates to a method for coating a surface with a layer by supplying liquid under pressure. The invention for instance relates to a coating of a layer on cylindrical surfaces and piston rods in pneumatic and hydraulic systems in order to increase their life and sealing effect.

BACKGROUND OF THE INVENTION

In for instance pneumatic systems, which to a great extent are used for mechanizing and automating heavy as well as light working conditions, oil mist is added to the compressed air via a so called oil mist lubrication aggregate for the pneumatic system to function. Since, however, this has a detrimental effect on the working environment and is dangerous to the health, it has for many years been an aim to cease using the admixture of oil mist.

With oil-free compressed air great demands must of necessity be put upon the pneumatic components. These great demands have comparatively well been met as to valve components. However, for instance concerning cylinders and pistons the problems to achieve required life and sealing against cylinder pipe and piston rod have not been overcome. The cylinder pipe is today among other things for corrosion reasons practically always made of aluminum—like many other pneumatic components, and the demands upon the inner surface of the aluminum pipe are satisfactory resistance to wear and low friction even when there is lack of lubricant. Moreover, a surface coating must be well adhering. In attempts to meet these demands there are method based on anodic treatment and Teflon (trademark) inpregnation. A disadvantage with these methods is that they are difficult to carry out in long pipes and this fact in combination with the comparatively large surfaces existing in pneumatic cylinders means, that the product becomes comparatively very expensive. As to piston rods, which usually are hard chromium plated, they must have a very fine surface but nevertheless great surface wear is obtained. Moreover, chromium is porous and often has crack formations and therefore action of rust and damages are obtained resulting in lowered life. In the dry state, i.e. without lubrication, the anodically treated surface and the chromium coated surface files off the sealings, usually sealings of rubber, and oxides of aluminum and chromium particles in-baked in sealing, piston guide and bushing wear on the pipe and the piston rod and deteriorate the surface. An accelerated wear course is obtained resulting in unsatisfactory life and sealing. Due to this one has been restricted to use a continuous lubrication with oil mist, in spite of the above mentioned disadvantages, often in combination with an initial lubrication with grease.

In hydraulic systems, in which the above mentioned problems with lubrication do not exist, one has, however, an essentially higher pressure and stress on the sealing surfaces. For obtaining a sealing satisfactory from the wear point of view the formation and maintenance of an oil film between sealing and co-operating surfaces is, however, required as well as a surface having high surface fineness. However, for practical and economic reasons the surfaces are too rough for obtaining quite a satisfactory result in this connection. The result of this is among other things that also with finest conceivable surfaces the sealings must be exchanged owing to wear down. When using for instance chromium-plated piston rods there are furthermore the above mentioned problems in view of the fact that chromium is porous and often has crack formations.

SUMMARY OF THE INVENTION

By the present invention the above mentioned problems and disadvantages have been eliminated and at the same time several advantages have been achieved. This is not only valid for said connection in pneumatic and hydraulic systems and with aluminum or chromium as the basic material, but the invention is highly useful for coating a surface of another material, both homogeneous and porous, as well as interior and exterior surfaces having round or plane shape. Summing up, the following advantages are achieved by the present invention:

The coating method is cheap and rapid.

The coating material, i.e. the liquid supplied under pressure, can be cheap.

Large surfaces can be coated at a low cost, for instance pipes and rods in long lengths.

The adhesion to underlying material is very good.

Besides the good adhesion a very good protection against corrosion is made possible.

The thickness of the coating can be controlled within close limits.

The coating method does not require great investments and long flow times, for instance as is the case in furnace hardening.

The coating method is not combined with risks for the working environment, as for instance upon lubrication with oil mist.

The attainment of above mentioned advantages has been made possible by the characterizing method steps according to the invention to subject the surface to be coated for vacuum in a vacuum zone sealed against the surface, to supply the liquid to said surface, which has been subjected to vacuum, in a pressure zone sealed against the surface, and spreading the liquid in a controlled manner to desired liquid thickness, wherein said steps are carried out during relative movement between the surface and said zones.

The invention makes possible the use of liquid according to the coating desired on the surface. The liquid can be chosen such that the coating becomes lubricating, i.e. a more or less flowing or semisolid coating, or liquid that hardens, for instance right up to enamel hardness, can be chosen. When, for instance, coating pneumatic parts, as for instance the above mentioned pipes of aluminum, in order to coat the surface with a good adhesive and penetrating layer having high wearing resistance and low friction even when lubricant is lacking this can be carried out in a simple and reliable manner with the method according to the invention. Preferably, slide lacquer or corresponding surface-improving liquid is used. A coating of surfaces on components in hydraulic systems creates a surface improved in wearing point of view with obtained and maintained film between sealing and surface which is perfectly satisfactory.

By the fact that the surface to be coated is subjected to vacuum before the spreading (painting) of the liquid, a very good adhesion of the coating is obtained. Owing to this, the liquid supplied in the pressure zone penetrates down into the pores in the surface and besides the good adhesion an improved corrosion protection is hereby obtained, for instance when lacquer is coated on anodized aluminum surfaces (for instance cylinder pipes) or chromate steel rods (for instance piston rods). Moreover, the spreading can according to the invention easily be controlled in respect to layer thickness for a certain liquid and its viscosity by choice of pressure, of relative velocity between the used coating device and the surface and of the shape of the sealing. Thus, the invention makes possible an accurate control of the layer thickness owing to the characteristics of the hydrodynamic film formation at the sealing.

In a preferred method according to the invention the spreading of the liquid is carried out by the sealing terminating the pressure zone. This provides for a particularly simple coating device. A sealing in the form of an O-ring can advantageously be used as a sealing operating as a very fine and exact "brush".

In cases an improved surface profile is desired, this can in accordance with the invention in an advantageous manner be carried out by plastic machining of the surface in the pressure zone prior to the spreading of the liquid, for instance by drawing.

Under certain circumstances it can be advantageous to coat a surface with more than one layer. This can according to the invention easily be carried out by supplying the liquid to at least two pressure zones positioned after each other and carry out the spreading by a sealing terminating each pressure zone. The possibility of supplying different liquids to the pressure zones is hereby also made possible.

Further characteristics and advantages of the invention will be evident from the following description of embodiments of the invention with reference to the accompanying drawings and to the claims following the description.

DRAWINGS

DESCRIPTION OF PREFERRED EMBODIMENTS

Figure 1:
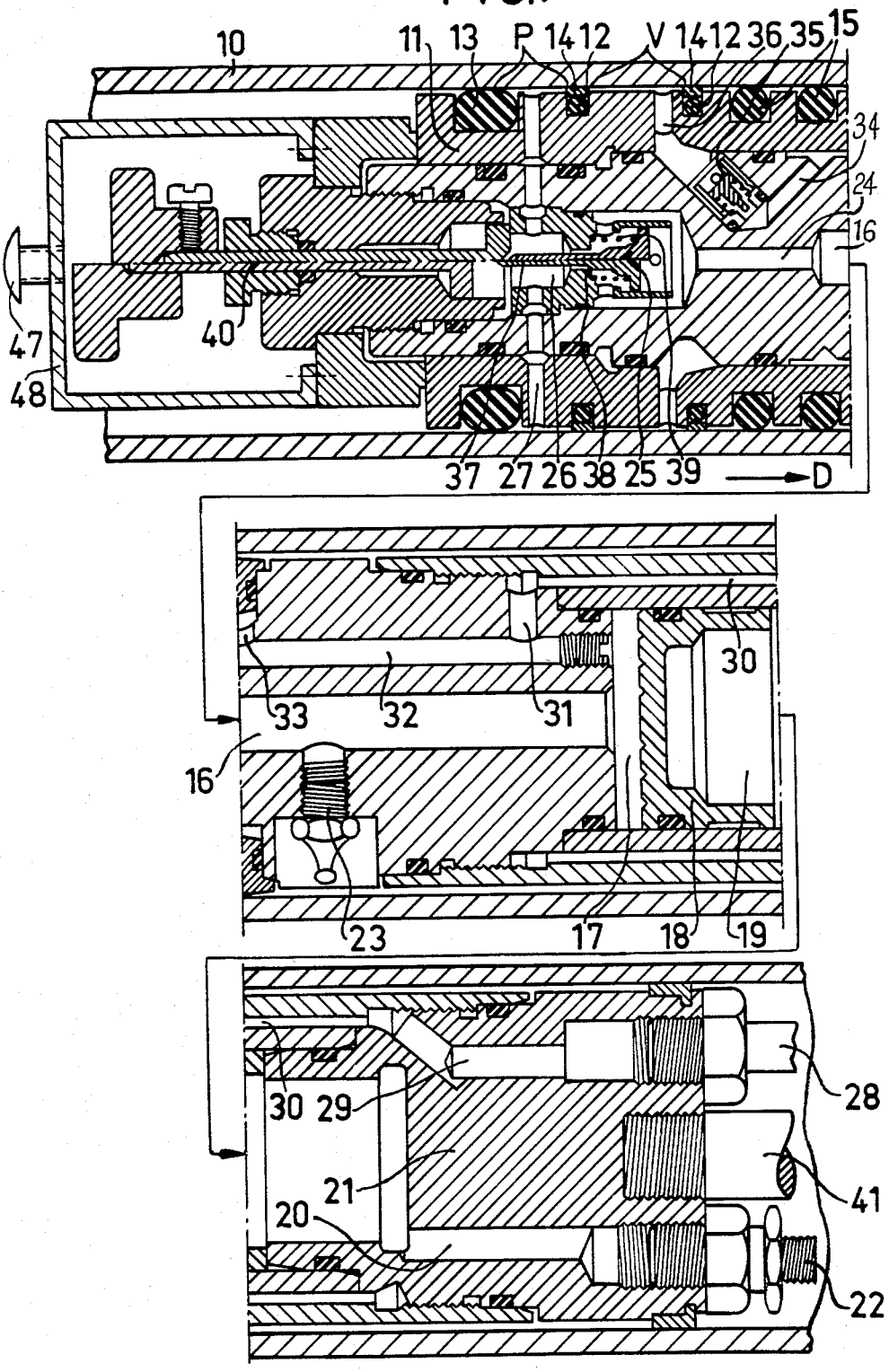
FIG. 1 is a central longitudinal section through an apparatus for internal coating of pipes.

The shown apparatus is constructed for coating the internal surface of pipe or tube 10 with appropriate liquid, for instance slide lacquer. By means of a sealing carrier 11 provided with sealings 12 and 13 a vacuum zone V and a pressure zone P, respectively, have been created against the tube 10. Sliding sleeve sealings 14 can, as shown, be arranged outside of the sealings 12. Moreover, a selected number of sealings 15 abutting the pipe are arranged in the sealing carrier ahead of the vacuum zone in the draw direction D of the apparatus.

For the supply of liquid to the pressure zone P the apparatus has a central channel 16 connected to a cylinder space 17, in which a piston 18 is running. The piston is driven by a gas accumulator 19 arranged therein which via channel 20 in end piece 21 is connected to a connection 22 for the supply of gas to the accumulator. The liquid is supplied to the channel 16 and the cylinder space 17 prior to the insertion of the apparatus in the tube 10 via a connection 23 to the channel 16 and upon the operation of the piston 18 the liquid is pressed via a channel 24 in communication with the channel 16 past a valve 25 in its open position to a central space 26 and from this space via channels 27 in the sealing carrier 11 to the pressure zone P.

Vacuum in the vacuum zone V is obtained via a connection 28 to a vacuum hose from a vacuum pump, via channels 29–34 in the apparatus, via valve 35 and via channels 36 in the sealing carrier.

In an apparatus as shown for coating the interior surface in pipes the vacuum valve 35 is preferably constructed such that the valve automatically opens, when the apparatus is inserted into the pipe, and automatically closes when the apparatus is removed from the pipe.

The liquid valve 25 is in FIG. 1 shown in two positions, namely above the central line of the figure in completely open position and below the central line in closed position. The valve is opened by displacement of its needle 37 from the valve seat 38 against the action of a tension spring 39 and the displacement is carried out by a rod 40, which like the needle 37 is shown in two positions above and below the central line of the figure, respectively.

The apparatus shown in FIG. 1 operates in the following manner.

When the apparatus with a velocity adapted to the liquid flow to the pressure zone P is drawn through the pipe, for instance by means of a draw rod 41 screwed into the end piece 21, the interior surface of the pipe is first subjected to vacuum in the sealed vacuum zone V, whereupon in the succeeding pressure zone P the liquid is supplied to the surface and also is pressed down into possible pores in the surface. The liquid is then spread out in a very even and thin layer and in the illustrated apparatus this spreading is carried out by means of the sealing 13 terminating the pressure zone, which accordingly also functions as a "brush". The thickness of the layer can be controlled by choice of sealing type, the viscosity of the liquid, pressure and draw velocity. The choice of these data can be done by means of a non-dimension figure, which is the same figure as is used upon analysis of hydrodynamic slide bearings (for instance in internal combustion engines) and upon analysis of sealings for hydraulic cylinders.

The sealings 15 positioned in the draw direction ahead of the vacuum zone V can be a practical complement to the coating device by improving the surface ahead of the vacuum zone and breaking down possibly existing extreme tops in the surface profile.

Figure 2:
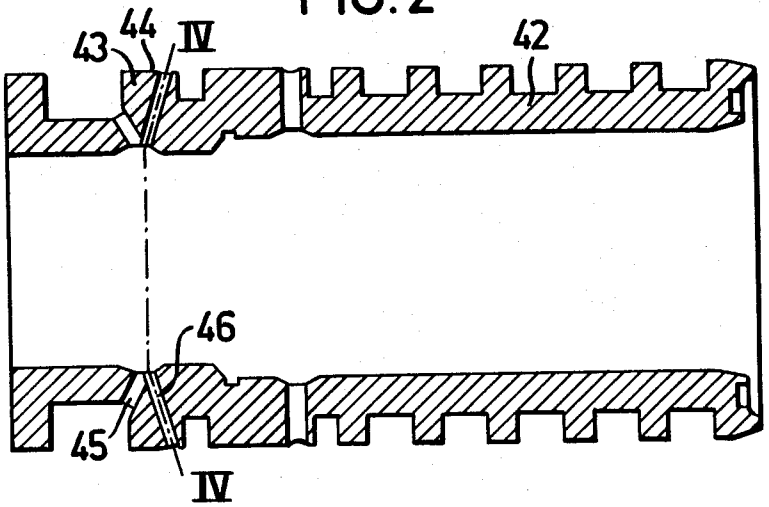
FIG. 2 is a longitudinal section through a sealing carrier in another form than that shown in FIG. 1.
Figure 4:
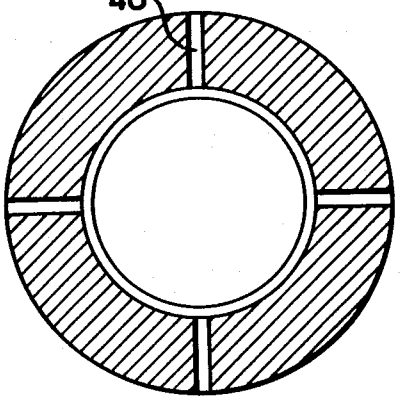
FIG. 4 is a section along the line IV—IV in FIG. 2.
Figure 3:
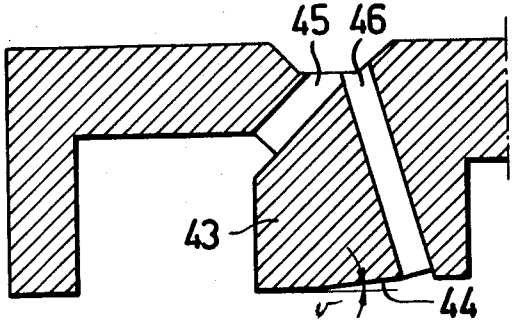
FIG. 3 shows in larger scale a part of the sealing carrier according to FIG. 2.

Another embodiment of a sealing carrier 42 corresponding to the sealing carrier 11 in FIG. 1 is shown in FIGS. 2 and 3. This sealing carrier 42 is provided with a drawing punch 43 having a drawing surface 44, by means of which the pipe surface is before the spreading of the liquid plastically machined in order to improve the surface profile. In this embodiment the liquid is via channels 45 and 46 supplied both ahead of and behind the drawing surface 44. As is best shown in FIG. 3, the drawing surface 44 makes a small angle v with the draw direction of the apparatus.

As the coating liquid, slide lacquer or a corresponding surface-improving liquid can be used. It can be particularly advantageous to use a rapid hardening liquid, for instance polyurethane with photo-initiated cross binding which rapidly hardens upon irradiation with ultraviolet rays. Such a UV-lamp 47 is schematically shown in FIG. 1 arranged at a socket 48.

The invention is not limited to the embodiment described above and shown on the drawings but can be varied in several ways within the scope of the following claims for carrying out a method for surface coating according to the invention. The method according to the invention can with adapted constructive configuration of the apparatus be carried out externally on pipes and rods as well as on other round surfaces than cylindrical as well as also on plane surfaces. The essence of the invention is that the used apparatus has against the surface in question a sealed vacuum zone followed by a sealed pressure zone having means for spreading the liquid to be coated and these method steps shall be carried out during relative movement between the apparatus and the surface. Moreover, if several layers shall be coated on the surface and/or different kind of liquids shall be used, more than one pressure zone can be arranged in the apparatus with supply of liquid to each pressure zone. For the plastic machining of the surface in the pressure zone another means than drawing punch can be arranged as well as several such means or drawing punches in the pressure zone or in pressure zones positioned after each other. It can finally be mentioned, that instead of having the apparatus movable relative to the surface, as shown on the drawings, the surface can be movable relative to a stationary apparatus or both the apparatus and the surface can be movable during the coating.

I claim:

1. A method of coating a surface comprising the steps of establishing a first zone which is disposed in sealed relation to a portion of said surface and which is movable relative to said surface in a defined direction, establishing at least one further zone which is disposed in sealed relation to a further portion of said surface and which is movable relative to said surface in said defined direction together with said first zone, said further zone being located behind said first zone in said defined direction of movement, evacuating said first zone to clean the portion of said surface adjacent said first zone and to remove air and impurities from pores in the said portion of said surface, supplying under pressure to said further zone a liquid to be coated onto said surface, said evacuating and liquid supplying steps being effected while said first and further zones are being moved relative to said surface in said defined direction thereby to cause said liquid in said further zone to be coated onto a portion of said surface which had previously been cleaned in said first zone as said zones are moved relative to said surface, and spreading said liquid to a desired layer thickness during said relative movement between said zones and said surface.

2. The method of claim 1 wherein said spreading step is effected by a sealing member which is used to seal the trailing edge of said further zone to said surface and which is movable together with said zones relative to said surface.

3. The method of claim 1 or 2 including the step of machining said surface plastically adjacent the leading edge of said further zone while said zones are being moved relative to said surface thereby to improve the profile of the portion of said surface which is thereafter coated with said liquid in said further zone.

4. The method of claim 1 wherein said further zone comprises at least two pressure zone sections which are disposed one after the other in said defined direction of movement.

5. The method of claim 4 wherein different liquids are applied under pressure to different ones of said pressure zone sections respectively.

6. The method of claim 1 wherein said surface has a cylindrical configuration.

7. The method of claim 1 wherein said liquid is slide lacquer.

8. The method of claim 1 wherein said liquid comprises a material which hardens when irradiated with ultraviolet rays, said method including the step of so irradiating the liquid which has been spread to a desired layer thickness during said relative movement between said zones and said surface.

9. An apparatus for coating a surface with a layer of liquid comprising a device disposed adjacent said surface for movement relative to and in sliding engagement with said surface, said device including first seal means in sliding engagement with said surface for defining a vacuum zone which is sealed against and movable relative to said surface, said vacuum zone being connected to a vacuum pump and being operative to remove air and impurities from the portion of the surface and from pores in said portion of the surface adjacent to said vacuum zone; said device including further seal means in sliding engagement with said surface for defining a pressure zone which follows said vacuum zone and which is sealed against said surface for movement relative to said surface together with said vacuum zone, said pressure zone being connected to a liquid source for supplying liquid under pressure to a portion of said surface previously treated in said vacuum zone during movement of said device relative to said surface; said device further including means for spreading the liquid supplied to said pressure zone onto said surface portion in a controlled manner and to desired thickness; and means for effecting relative movement between said surface and said device.

10. The apparatus of claim 9 wherein said vacuum and pressure zones are spaced from one another by a common sealing member.

11. The apparatus of claim 9 or 10 wherein said spreading means consists of a sealing member located at the trailing edge of said pressure zone.

12. The apparatus of claim 9 wherein said device includes means for plastic machining the surface prior to said spreading of the liquid.

* * * * *